United States Patent [19]

Gdanski

[11] 4,141,372

[45] Feb. 27, 1979

[54] VIBRATORY COIN FEEDER

[76] Inventor: Ronald C. Gdanski, P.O. Box 307, Grimsby, Ontario, Canada

[21] Appl. No.: 862,187

[22] Filed: Dec. 19, 1977

[30] Foreign Application Priority Data

Oct. 5, 1977 [CA] Canada ..... 288200

[51] Int. Cl.[2] ..... G07D 9/00

[52] U.S. Cl. ..... 133/1 R; 133/3 H; 198/447; 198/771

[58] Field of Search ..... 133/1 R, 3 R, 3 A–3H; 198/771, 446, 447; 193/DIG. 1; 206/0.8, 0.81, 0.84; 221/178, 179

[56] References Cited

U.S. PATENT DOCUMENTS

| | | | |
|---|---|---|---|
| 1,120,081 | 12/1914 | Potter | 206/0.84 |
| 3,469,672 | 9/1969 | Stutske et al. | 198/771 X |
| 3,752,168 | 8/1973 | Bayha | 133/3 D |

*Primary Examiner*—Stanley H. Tollberg
*Assistant Examiner*—Francis J. Bartuska
*Attorney, Agent, or Firm*—Colton & Stone, Inc.

[57] ABSTRACT

A vibrating feeder for feeding disc-like objects such as coins to a subsequent work station such as a coin sorter has a unitary box-like structure provided with a particularly contoured bottom. The bottom defines a main flow path and an auxiliary flow path leading to the main flow path which in turn terminates in an exit for the coins. The auxiliary flow path has longitudinally inclined fins for guiding coins to the main flow path while somewhat retarding the flow rate to avoid jamming of coins and to avoid an excessive flow rate. Each flow path also includes one or more troughs contoured so that a coin will not lie flat thereon. The feeder is inexpensive to produce, is simple in execution and operation and provides a controlled flow rate for coins or other objects to the subsequent work station.

16 Claims, 7 Drawing Figures

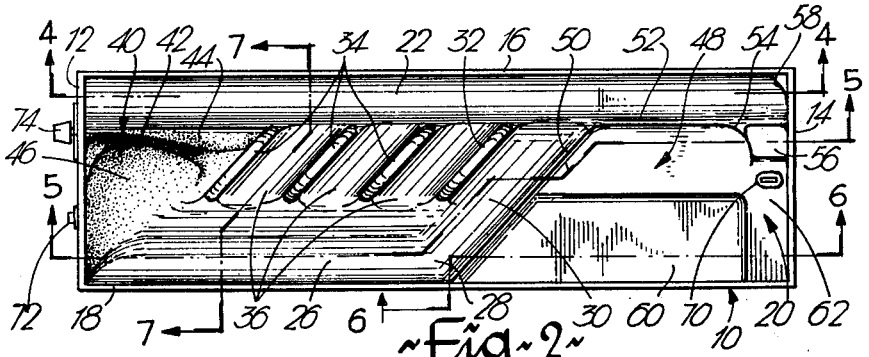
~Fig-2~
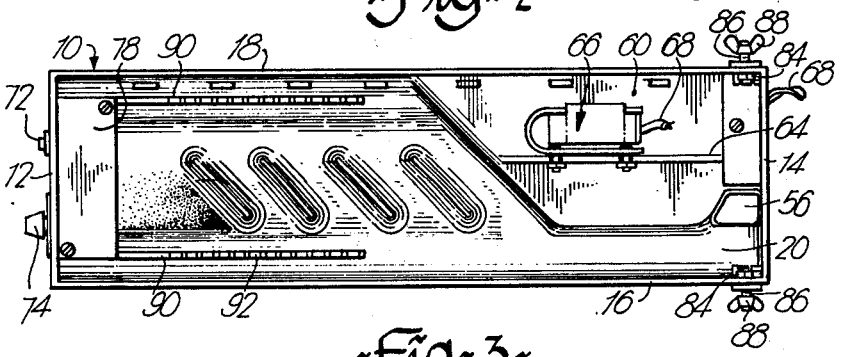
~Fig-3~
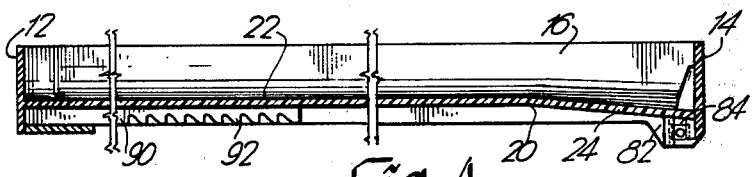
~Fig-4~
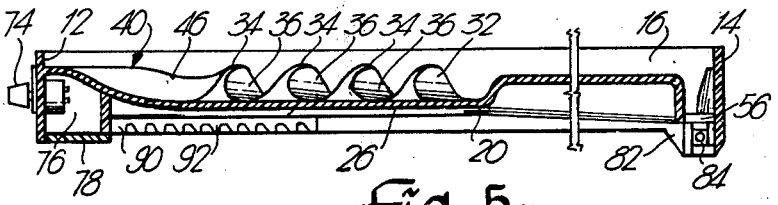
~Fig-5~
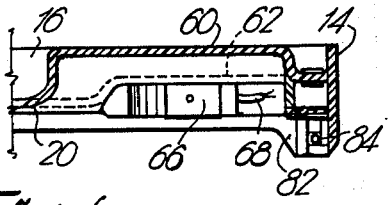
~Fig-6~

VIBRATORY COIN FEEDER

The present invention relates in general to vibratory feeders for disc-like objects and in particular to a vibratory feeder for coins to be fed to a coin sorter.

BACKGROUND OF THE INVENTION

In the sorting of large quantities of disc-like objects such as coins, consideration of labor costs dictates that as much work as possible should be accomplished by automatic means. There are many machines available for mechanically sorting and counting coins but, generally speaking, these machines are of a complex structure with electric motors and many mechanical parts; they are costly to produce and they are subject to breakdowns. Such devices often utilize vibratory means in a feeder portion to induce movement of the objects to a sorter or other equipment. Also while the present invention relates particularly to the feeding of coins it is understood that feeders for other disc-like objects such as washers, buttons and bottle-caps are afflicted with the same problems as are coin feeders and sorters. Representative devices are found in Canadian Pat. Nos. 946,008 (Gess) and 946,009 (Hodgins) both issued Apr. 23, 1974 and in U.S. Pat. No. 3,752,168 (Bayla) issued Aug. 14, 1973. The two Canadian Patents use spiral vibratory feeders to move articles (bottle caps and buttons respectively) in a single line to a chute device which feeds the articles, one at a time, to a subsequent work station. Such equipment would not be suited to feeding disc-like objects having different diameters and thicknesses as they would be prone to jamming and piling. The U.S. patent shows a vibratory feeder for feeding a random mix of coins to a coin sorter but the structure thereof is complex, expensive to produce and could be prone to jamming. Specific means must be provided to avoid piling up of coins and the feeding of unwanted coins.

There is also a need for a feeding device for manual coin sorters such as that defined in my Canadian Pat. No. 769,469 issued Oct. 17, 1967. That coin sorter is a small unitary device provided with chutes of different widths and depths for the sorting of coins into stacks convenient for wrapping. To operate this sorter the operator feeds coins by hand to a receiving area at the top thereof, allowing the coins to proceed, by gravity, along their respective chutes until he has coins sorted for a roll. He than proceeds to roll-wrap and he thus alternates between feeding and roll-wrapping. This sorter is ideal for small volume coin handling but does not have the capacity for large volume jobs. It is desirable, therefore, to combine this device with a mechanical coin feeder which could at least double the coin handling efficiency of the sorter. In order to make such a feeder attractive from an economic standpoint it must be less complex than previously available units, it must reduce as much as possible any jamming of the coins, it must be relatively inexpensive to produce and it must be readily mountable on the coin sorter.

SUMMARY OF THE INVENTION

To meet the above-identified requirements I have devised a mouldable vibratory feeder which can be inexpensively produced, avoids the possibility of serious jamming situations and which will accept coins in small groups, say 10 to 20 at a time, up to larger volumes of coins, say several hundred. It is readily adaptable to my previous coin sorter and it effectively reduces coins from a large volume to a uniform flow suitable for the capacity of the coin sorter or the capacity of the operator who wishes to complete subsequent coin handling operations such as counting and wrapping.

The present invention is not limited to the feeding of coins although that was the original purpose for which it was designed. It would be readily adaptable to the feeding of other disc-like objects such as washers, buttons or bottle caps whether such objects have uniform or different diameters and/or thicknesses.

The present invention provides a box-like structure having a particularly profiled bottom which results in the desired flow pattern for the objects. The bottom has a main trough establishing a first flow path, the trough extending the length of the structure and terminating in an opening for feeding the objects to a subsequent work station. An auxiliary flow path feeds objects to the main trough and includes a second trough parallel to but shorter than the main trough and at a higher elevation than the main trough. A plurality of longitudinally angled upwardly projecting guide fins extend between the two troughs and are separated by downwardly inclined guide troughs providing flow paths from the second trough to the first trough. A raised area between the first and second troughs at the end opposite the opening permits objects placed thereon to flow to each of those troughs. A vibratory motor is also provided to impart vibrations to the entire structure the vibrations produced thereby serving to induce movement of the objects along the flow paths and to vibrate loose any objects that might jam together. The fins tend to reduce the flow rate along the auxiliary flow path, thereby reducing the possibility of jamming and reducing the pressure of objects against the objects flowing from the auxiliary to the main flow path. All troughs are contoured so that even the smallest object to the fed will not lie flat in any of the troughs. When supported in this manner the objects will readily rock on the opposed points thereby aiding in separating the objects from groups to a single layer. They will flow more readily as there is less friction, due to minimum surface contact. Also the operation will be quieter as there will be less tendency for the objects to bounce than if they were flowing on a vibrating flat surface. Essentially each object is supported in each trough at diametrically opposed points on its outer circumferential edge. The contoured bottom may be moulded as a unitary component of the feeder and then the side and end walls attached or, in fact, the entire structure could be moulded as a sngle unit. Means may be provided for attaching the structure to a subsequent work station such as a coin sorter as defined in Canadian Pat. No. 769,969.

In its broadest form therefore the present invention may be defined as a feeder for disc-like objects comprising a generally box-like structure having opposed side and end walls and a bottom wall, said bottom wall defining a first flow path extending the length of said structure and terminating adjacent one end wall at an opening in said bottom wall, a second flow path having a first portion parallel to said first path and auxiliary portions linking said first portion to said first path, said first portion being raised relative to said first path and said auxiliary portions being angled forwardly relative to said first portion, each of said paths having an upper surface contoured so that the smallest object to be fed will not lie flat thereon, and a raised area adjacent the other end wall between said first path and first portion, said area defining flow routes towards each of said flow paths, and means for imparting vibrations to said structure.

BRIEF DESCRIPTION OF THE DRAWINGS

FIG. 2 shows a top view of the coin feeder of the present invention;

FIG. 3 shows a bottom view of the coin feeder;

FIGS. 4, 5 and 6 show sections of the coin feeder as taken along the lines 4—4, 5—5 and 6—6 respectively of FIG. 2;

DESCRIPTION OF THE PREFERRED EMBODIMENT

Figures 1, 7:
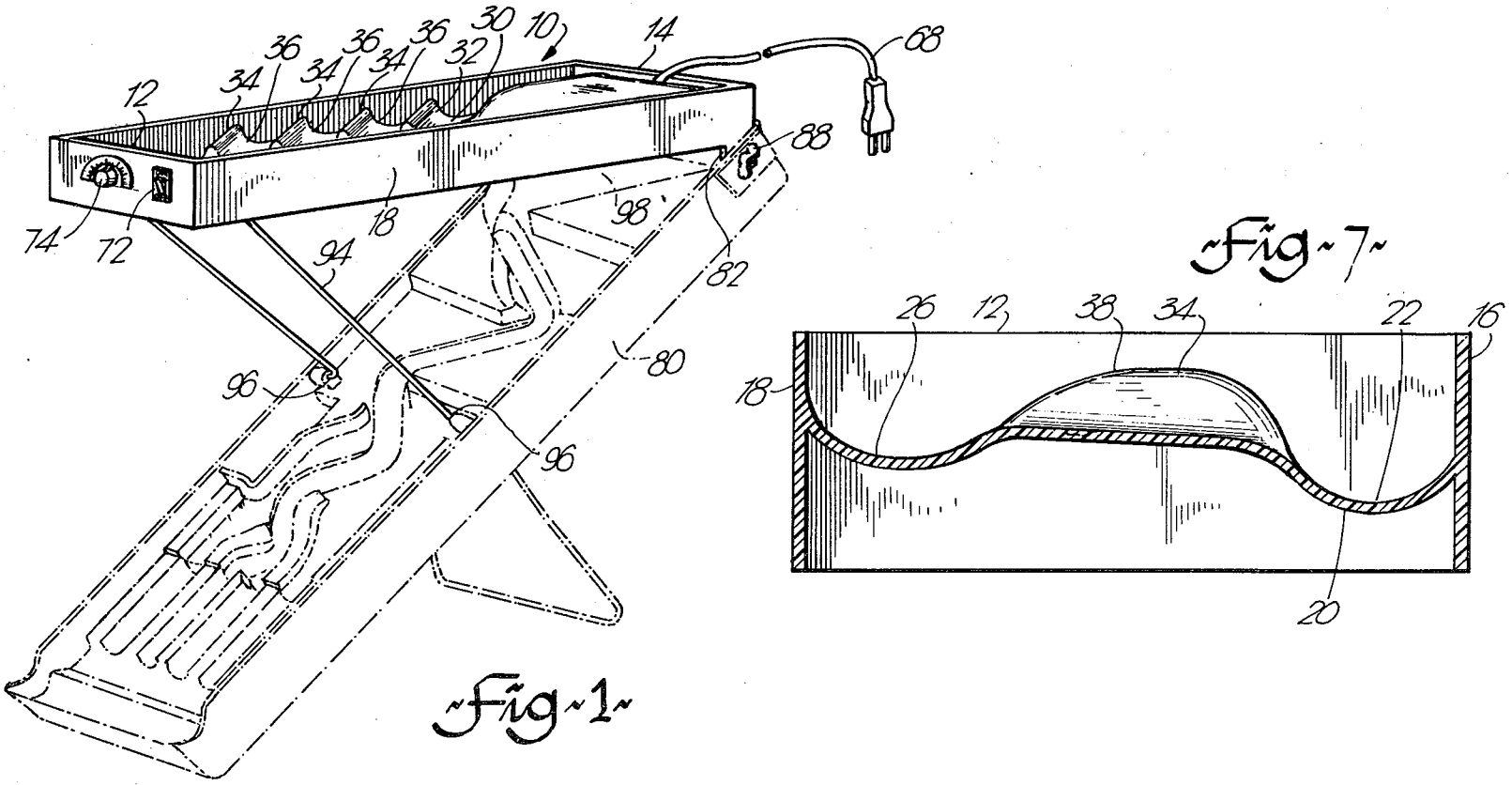
FIG. 1 shows the coin feeder of the present invention in position on a coin sorter (shown in dash-dot lines)
FIG. 7, appearing on the same sheet as FIG. 1, shows a section of the coin feeder as taken along the line 7—7 of FIG. 2.

As is readily seen in FIGS. 1, 2 and 3 the coin feeder of the present invention comprises a generally box-like structure 10 having opposed end walls 12 and 14, opposed side walls 16 and 18 and a bottom wall 20. While the side and end walls may each be generally rectangular so as to retain coins within the structure, the bottom wall is profiled in a particular manner in order to provide an optimum flow pattern for coins to be fed.

Turning now to FIGS. 2, 4 and 7 it is seen that bottom wall 20 is provided with a trough portion 22 defining a first flow path and extending substantially from one end wall 12 to the other end wall 14, adjacent one side wall 16. The trough portion 22 has a cross-section which results in a concave upper surface, the radius of curvature being such that even the smallest coin to be fed will not lie flat on the surface but will be supported only at two diametrically opposed points. While the trough portion 22 may extend to a smooth straight line from end wall 12 to end wall 14 it is preferred that a section 24 of the trough portion 22 slope downwardly in the vicinity of end wall 14. This feature is shown in the longitudinal section of FIG. 4.

The bottom wall 20 is provided with a second trough portion 26 seen in FIGS. 2, 5 and 7. The second trough portion defines a first portion of a second flow path and starts adjacent end wall 12 extending adjacent the other side wall 18 to a zone 28 intermediate the end walls 12 and 14. As seen in FIG. 7 trough portion 26 is also provided with a generally concave upper surface, that surface being raised relative to the upper surface of trough portion 22. As with trough portion 22, the radius of curvature for trough 26 is such that even the smallest coin to be fed will not lie flat thereon.

FIG. 2 illustrates auxiliary portions of the second flow path linking the first portion (trough 26) with the first flow path (trough 22). A connecting trough 30 merges smoothly with trough portions 26 and 22 and inasmuch as trough portion 26 is raised relative to trough portion 22, the connecting trough will actually slope downwardly from trough portion 26 to trough portion 22. As shown in FIG. 2 the connecting trough 30 merges smoothly with the trough portion 26 at the zone 28 and, further, connecting trough 30 is angled with respect to the direction of flow defined by the trough portions 22 and 26 as being from the end wall 12 towards the end wall 14.

A suitable angle for the trough 30 is found between 40 and 60 degrees with respect to the flow direction with 50° being optimum.

Immediately adjacent the connecting trough 30 is a generally upright protruding guiding fin 32, the fin 32 extending no higher than the upper edge of the end and side walls. The fin 32 is parallel to the connecting trough 30 and it extends between the inside longitudinal edge of the trough portion 26 and the trough portion 22. Spaced apart from but parallel to the fin 32 are other guiding fins 34, being substantially identical to the fin 32. Between guiding fin 32 and the next adjacent fin 34 as well as between each pair of fins 34 is a guide trough 36, each trough 36 merging smoothly with the trough portions 26 and 22 in the same manner as the connecting trough 30. As with trough 30, the troughs 36 will slope downwardly from the trough portion 26 to the trough portion 22 and they are contoured in the same manner as trough portions 22 and 26.

FIGS. 2, 4 and 7 illustrate the fins 32, 34 and the troughs 30, 36 in greater detail. The upper peripheral edge 38 of the fins is smoothly curved and the side edges of each fin curve downwardly and outwardly to form the sides of the intervening trough 36.

As viewed in FIG. 2 the left hand side of the fin 34 adjacent end wall 12 merges smoothly into a raised contoured area 40 having a ridge portion 42 and sloping sides 44, 46. The ridge portion extends between end wall 12 and the adjacent fin 34 and is at substantially the same height as the fins 34. The ridge portion 42 is also positioned in the area 40 so as to be closer to the trough 22, resulting in side 44 having a steeper slope than the side 46. Each side 44, 46 is smoothly curved so as to have a slightly concave upper surface, which surface merges smoothly with the respective trough 22, 26.

Between the trough 30 and the end wall 14 the bottom 20 is provided with a two-level planar portion 48 having an edge wall 50 defining one edge of the trough 30 and a second edge wall 52 defining a portion of the edge of trough 22. Edge wall 52 terminates in a curved wall portion 54 which leads to an opening 56 in the bottom wall 20. Opening 56 is sized to permit several of the largest coins to be fed to pass therethrough. In order to facilitate coin flow to opening 56 a curved wall 58 is provided in the corner defined by walls 14 and 16.

As indicated above, planar portion 48 has two levels, level 60 being raised relative to level 62, although level 60 is no higher than the top of the side or end walls. Level 62 is at a height sufficient to define the edge of the troughs 30 and 22 passing thereby.

Turning now to the bottom view of FIG. 3 it is seen that level 60 forms a cavity defined by a wall 64 to which is attached a vibratory motor 66. This motor may be of any of the commercially available units and it has a cord 68 connectable to a standard AC outlet, the cord 68 passing through an opening 70 in level 62. The motor 66 is also connected by an electrical cord, (not shown) to an on-off switch 72 and a rheostat 74 mounted in the end wall 12 of the device. These control the operation of the feeder and, being commercially available, need not be described. As shown in FIGS. 3 and 5 these controls may be sealed in a cavity 76 formed adjacent end wall 12, the cavity being accessible via a removable closure plate 78.

As indicated previously, the feeder of the present invention may be advantageously used with a coin sorter as defined in Canadian Pat. No. 769,469 and such a sorter is shown in phantom outline in FIG. 1 by reference number 80. To enable assembly to such a coin sorter a pair of downwardly depending lugs 82 may be provided as extensions of the side walls 16, 18 adjacent end walls 14. On the inside wall of each lug may be held a captive nut 84 which may receive a threaded screw portion 86 and a wing nut 88. Each screw 86 is receivable in a slot (not shown) provided in the upper side walls of the sorter, thereby providing a pivot axis for the feeder relative to the sorter. The feeder may be clamped to the sorter by the wing nuts 88 which clamp the adjacent side wall of the sorter against the respective lug 82.

In order to support the other end of the feeder above the sorter the bottom wall is provided with a pair of parallel rack members 90 having a plurality of spaced indentations 92. A U-shaped wire member 94 may be pivotally attached to the sorter as at 26 so that the bottom of the U is engageable with the indentations 92. The slope of the feeder relative to the sorter can be adjusted by placing the member 94 in different sets of indentations 92.

It is expected that the entire unit can be injection moulded of ABS or styrene in a single operation with the mould dies producing the sides and imparting the specific contour to the bottom. The sides 12, 14, 16, 18 may be formed from sheet material to which the bottom is attached in a conventional manner. It is suggested that the entire unit may be formed from a plastics material such as polystyrene or polyvinylchloride.

The operation of the coin feeder according to the present invention will now be described, assuming that the feeder 10 is assembled to a sorter 80 as illustrated in FIG. 1, utilizing the assembly components described hereinabove. It is noted that end wall 14 is adjacent the upper end of the inclined sorter so that opening 56 is positioned just above the normal inlet area 98 of the sorter 80. It is also suggested that the feeder 10 be positioned so that it has a slight downwards slope relative to the horizontal from end 12 towards end 14. This slope is not essential especially if trough 22 is sloped as at 24 as suggested above, but such a slope will aid in the feeding of coins.

A random quantity of coins is then placed in the feeder, primarily in the vicinity of the contoured area 40 although if a substantial quantity of coins is to be fed and sorted the coins may initially fill the troughs 22, 26, 30, 36 and in fact may be piled thereon to at least the height of the walls 12, 14, 16, 18. The walls are of a suitable height to provide ample volume and to eliminate overloading by allowing excess coins to spill thereover. With control 74 set for minimum vibratory output from motor 66, switch 72 is turned on. Control 74 may then be operated to increase the output of motor 66 so that the vibratory output thereof is transmitted to the feeder. The vibrations are transmitted to the coins piled in the feeder thereby greatly reducing the effects of friction or jamming and, aided slightly by gravity if the feeder is sloped and also aided by the inclinations designed into the troughs 22, 30, 36 and the sloping sides 44, 46 the coins will begin to follow the troughs 22, 26, 30, 36 in a general direction towards the opening 56. As the coins encounter the opening 56 they will pass therethrough one at a time or in small groups into the receiving area 98 of the sorter 80 from whence they will flow downwardly in the sorter to their appropriate sorted locations.

The particular configuration of troughs, fins and contoured areas in the present invention aids greatly in avoiding or rectifying any jamming of coins. A uniform flow rate can be established along trough 22 leading to opening 56. Coins piled in the remainder of the feeder will flow along troughs 26, 30, 36, around fins 32, 34 and area 40 towards the trough 22 but their flow rate is retarded relative to that of the coins in trough 22, primarily by the fins 32, 34. Also should coins jam at an exit from a trough 30, 36 coins will continue to flow to another trough and thence to the trough 22. Any jammed coins, caused by a smaller coin occupying open space between larger coins, and bridging an exit, will be shaken loose by the vibrations imparted by the motor 66. This is aided by the flow pattern of the coins which effectively reduces any pressures formed by a build-up of coins behind a jam of coins.

To summarize the operation and advantages of the present coin feeder, it is seen that the construction is such as to enable coins to follow a main flow path, trough 22, with a plurality of auxiliary flow paths defined by trough 30, 36 providing a supply of coins for the main flow path. Coins which may be prevented, due to a temporary jam, from flowing along a trough 36 have a second exit in the form of trough 26 which carries coins generally towards the opening 56. Fins 32, 34 retard the flow of coins so that the flow rate is more easily controlled and the raised area 40 ensures that there will be no area in the feeder where coins will not flow as the sloping sides thereof provide for gravity flow at the very least. Tests have shown that vibrations tend to be cancelled in the vicinity of area 40 and hence it is advisable to counter-act such a dead area vibrationwise with the raised area 40 for coin flow.

The rate of coin flow can be controlled by altering the slope of the feeder relative to the sorter and/or by altering the amplitude of the vibrations via control 74. In any event the operator can adjust the flow rate so that as coins are sorted in the sorter 80 he can comfortably wrap the coins as the required quantity of each denomination is reached. He can, at any time as is convenient, place more coins in the feeder and he can accordingly obtain a higher rate of wrapping as it is no longer necessary for him to manually place a handful of coins in the loading zone of the sorter, wait for those coins to be sorted, reload the sorter, wrap, and repeat these various operations as required.

It should be pointed out that the use of the present feeder device does not prevent the use of the sorter in a fully manual mode. Furthermore, the present feeder should not be restricted to use with a coin sorter such as that defined in Canadian Pat. No. 769,469. It is conceivable that the present feeder could be utilized to feed, at a desired flow rate, other disc-like objects such as washers or buttons and that it could be used with other coin handling devices as well. It is also expected that skilled practitioners in the art could effect changes in the design of the present invention without affecting the basic concept. Accordingly, the protection to be afforded the present invention should be determined from the appended claims.

The embodiments of the invention in which an exclusive property or privilege is claimed are defined as follows:

1. A feeder for disc-like objects comprising (a) a generally box-like structure having opposed side and end walls and a bottom wall;

(b) said bottom wall defining:

(i) a first flow path extending the length of said structure and terminating adjacent one end wall at an opening in said bottom wall;

(ii) a second flow path having a first portion parallel to said first path and auxiliary portions linking said first portion to said first path, said first portion being raised relative to said first path and said auxiliary portions being angled forwardly relative to said first portion;

(iii) each of said paths having an upper surface contoured so that the smallest object to be fed will not lie flat thereon; and (iv) a raised area adjacent the other end wall between said first path and said first portion, said area defining flow routes towards each of said flow paths; and (c) means for imparting vibrations to said structure.

2. A feeder according to claim 1 wherein said first flow path comprises a first trough adjacent one side wall, said first portion of said second flow path comprises a second trough adjacent the other side wall extending from said other end wall to a zone intermediate said end walls, and said auxiliary portions of said second flow path comprise a plurality of parallel guiding troughs merging smoothly with said first and second troughs along portions of the lengths thereof.

3. A feeder according to claim 2 wherein one of said guiding troughs merges with said second trough at said intermediate zone and wherein each guiding trough is separated from its adjacent guiding trough by an upright guide fin protruding from said bottom wall.

4. A feeder according to claim 3 wherein each side wall of each guiding trough merges smoothly with the side of its adjacent guide fin.

5. A feeder according to claim 4 wherein the side wall of said one guiding trough closest said one end wall defines an edge wall of a raised two-level planar portion, the higher level of said planar portion defining a cavity on the underside of said bottom wall for containing said means for imparting vibrations to said structure.

6. A feeder according to claim 2 wherein said raised area has a ridge portion and said flow routes are defined by sloping surfaces leading from said ridge portion to merge smoothly with said first and second troughs respectively.

7. A feeder according to claim 2 wherein said first trough has a downwardly sloping portion leading to said opening.

8. A feeder according to said claim 1 wherein the angle of said auxiliary portions is in the range of 40 to 60 degrees with respect to said first flow path.

9. A feeder according to claim 1 and including control means for adjustably controlling the amplitude of vibrations produced by said vibration means.

10. A device for controlled feeding of a mixture of assorted coins comprising:

(a) a generally box-like structure having opposed side and end walls and a bottom wall;

(b) said bottom wall including:

(i) a first trough portion extending from one end wall to the other end wall adjacent one side wall (ii) a second trough portion extending, adjacent the other side wall, from adjacent said one end wall to a zone intermediate the length of said other side wall, said second trough portion being raised relative to said first trough portion;

(iii) a first guiding trough angled with respect to the centreline of said structure and merging with said first trough and with said second trough at said zone;

(iv) a plurality of upright parallel protruding guide fins extending between said first and second troughs, said fins being separated from each other by a plurality of guiding troughs merging with said first and second portions (v) said first guiding trough, said fins and said plurality of guiding troughs being parallel to each other;

(vi) each of said trough portions and said guiding troughs having an upper surface contoured so that the smallest coin to be fed will not lie flat thereon;

(vii) a raised area adjacent said one end wall and between said first and second troughs, provided with surfaces sloping respectively towards said first and second trough portions; and (viii) an opening in said first trough portion adjacent said other end wall sized to permit coins to pass therethrough; and (c) means to impart vibrations to said structure.

11. The coin feeder of claim 10 wherein side wall of each guiding trough merges smoothly with the side of its adjacent guide fin.

12. The coin feeder of claim 10 wherein said raised area has a ridge portion and said surfaces lead from said ridge portion to merge smoothly with said first and second trough portions respectively.

13. The coin feeder of claim 10 wherein said first trough portion has a downwardly sloping portion leading to said opening.

14. The coin feeder of claim 10 wherein the angle of said guiding troughs and said guide fins is in the range of 40 to 60 degrees with respect to said centerline.

15. The feeder of claim 10 and including control means for adjustably controlling the amplitude of vibrations produced by said vibration means.

16. The feeder of claim 10 and including means for adjustably connecting said feeder to a coin sorter.

* * * * *